United States Patent [19]

Griffith, Jr. et al.

[11] 4,369,723

[45] Jan. 25, 1983

[54] NEEDLE LUBRICATOR SYSTEM

[75] Inventors: William C. Griffith, Jr.; Charles E. Brocklehurst, both of Fountain Inn, S.C.

[73] Assignee: Opelika Manufacturing Corporation, Chicago, Ill.

[21] Appl. No.: 238,037

[22] Filed: Feb. 25, 1981

Related U.S. Application Data

[63] Continuation of Ser. No. 97,553, Nov. 26, 1979, abandoned, which is a continuation of Ser. No. 954,934, Oct. 26, 1978, abandoned.

[51] Int. Cl.[3] ..... D05B 71/04

[52] U.S. Cl. ..... 112/281

[58] Field of Search ..... 112/281, 280, 270, 42, 112/43, 256; 239/132, 132.1, 132.3; 184/55 R

[56] References Cited

U.S. PATENT DOCUMENTS

| | | | |
|---|---|---|---|
| 1,332,536 | 3/1920 | Baynard | 112/281 |
| 1,758,101 | 5/1930 | Bates | 112/281 |
| 2,373,734 | 4/1945 | Albero | 112/281 X |
| 2,457,362 | 12/1948 | Giglio | 112/281 |
| 2,885,984 | 5/1959 | Earnhart | 112/281 |
| 3,382,681 | 5/1968 | Hagy | 112/281 X |
| 3,611,958 | 10/1971 | Rutledge | 112/281 |

FOREIGN PATENT DOCUMENTS

| | | | |
|---|---|---|---|
| 8018 | 8/1877 | Canada . | |
| 199205 | 4/1920 | Canada . | |
| 962135 | 4/1957 | Fed. Rep. of Germany | 112/281 |
| 1133225 | 7/1962 | Fed. Rep. of Germany . | |
| 2617791 | 3/1977 | Fed. Rep. of Germany | 112/281 |
| 2730866 | 1/1979 | Fed. Rep. of Germany . | |
| 651108 | 3/1951 | United Kingdom | 112/281 |
| 757858 | 9/1956 | United Kingdom | 112/281 |

*Primary Examiner*—H. Hampton Hunter

*Attorney, Agent, or Firm*—George M. Thomas

[57] ABSTRACT

The pointed tip of a sewing machine needle is immersed in a liquid lubricant as it reaches the lower end of its downward stroke through the material being sewn, so as to coat the tip of the needle with a lubricant and reduce the friction and therefore the heat generated by the friction between the needle and the material being sewn.

4 Claims, 3 Drawing Figures

NEEDLE LUBRICATOR SYSTEM

This application is a continuation, of application Ser. No. 097,553, filed Nov. 26, 1979, now abandoned, which was a continuation of 954,934, filed Oct. 26, 1978, now abandoned.

DESCRIPTION

1. Technical Field

This invention relates to sewing machines, particularly to the reduction of heat and friction of the sewing machine needle caused by the rapid, repeated penetration of the fabric by the needle. It is desirable to reduce the heat of the sewing machine needle to avoid deterioration of the needle, of the needle thread and of the material being sewn, and it is also desirable to reduce the friction between the needle and the material being sewn to avoid the use of additional power to force the needle through the material.

2. Background of the Invention

During the operation of a sewing machine wherein a reciprocating sewing needle is repeatedly thrust through the material being sewn, the needle becomes hot because of the friction between the needle and the material it penetrates. The greatest frictional contact between the needle and the material is at the point or tip of the needle which must separate the fibers of the material as the needle enters the material. The frictional contact between the needle and the material is aggravated as the polyester and other resins from the material accumulate on the needle, particularly at the tip of the needle. The build-up of polyester and other contaminants increases the frictional drag of a needle as it penetrates the material, causing the needle to become hot.

When the needle thread is pulled to and passes through the eye of the sewing needle, the thread is likely to burn if the needle is excessively hot, particularly when the sewing machine is stopped and the needle still extends down through the material being sewn. In some sewing machines a stream of air is continuously directed toward the needle above the throat plate of the sewing machine so as to cool the needle as it sews; however, the tip of the needle, which is the hottest portion of the needle, is difficult to cool, particularly when the needle is in its down position.

Prior efforts have been made to cool or lubricate a sewing needle in the area below the throat plate of the sewing machine, when the needle has penetrated the material, but most efforts have not been successful. For example, it is believed that a strip of felt soaked with a lubricant has been placed beneath the throat plate of a sewing machine so as to have the lubricant applied to the needle by the felt material during the downward stroke of the needle; however, this technique does not appear to function over a long period of time, apparently because the felt becomes impacted by the needle or becomes dislocated and does not make contact with the needle.

SUMMARY OF THE INVENTION

Briefly described, the present invention comprises a method and apparatus for lubricating and cooling the needle of a sewing machine, whereby the tip of the sewing needle is coated with a lubricant during the sewing function to reduce the friction encountered between the needle and the material being sewn, thereby reducing the heat generated in the sewing needle during the sewing function. A small container is positioned beneath the throat plate of the sewing machine with an opening in the container aligned with the path of the needle at an elevation above the lower end of the downward stroke of the needle, whereby the tip of the needle enters the container during the sewing function. A receptacle which functions as a reservoir is located at an elevation higher than the container, and a conduit connects the reservoir to the container. A lubricant fluid is present in the reservoir and moves through the conduit to the container to continuously supply the container with the lubricant that wets the tip of the needle.

A stream of cool air is directed against the sewing needle above the throat plate so as to cool the needle as it withdraws from the material, and the thread moving to the sewing needle is coated with a lubricant which reduces the drag of the thread as it passes through the eye of the needle and through the material being sewn.

Thus, it is an object of this invention to provide a method and apparatus for reducing the friction encountered between the needle of a sewing machine and the material being sewn, thereby reducing the heat generated by the friction in the sewing needle.

Another object of this invention is to increase the speed of operation of a sewing machine during its sewing function without increasing the hazard of breaking the needle thread.

Another object of this invention is to provide apparatus for immersing the tip of the sewing needle of a sewing machine in a lubricant as the sewing needle reciprocates during the sewing operation.

Other objects, features and advantages of the present invention will become apparent upon reading the following specification, when taken in conjunction with the accompanying drawing.

DETAILED DESCRIPTION

Figure 1:
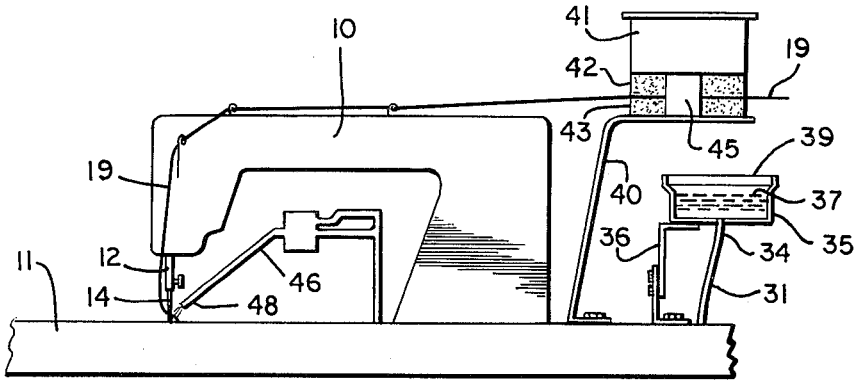
FIG. 1 is a side view of a sewing machine which includes the needle lubricator system.

Referring now in more detail to the drawings, FIG. 1 illustrates a sewing machine 10 mounted on a work table 11 and which includes a conventional needle bar 12 and sewing needle 14.

Figure 2:
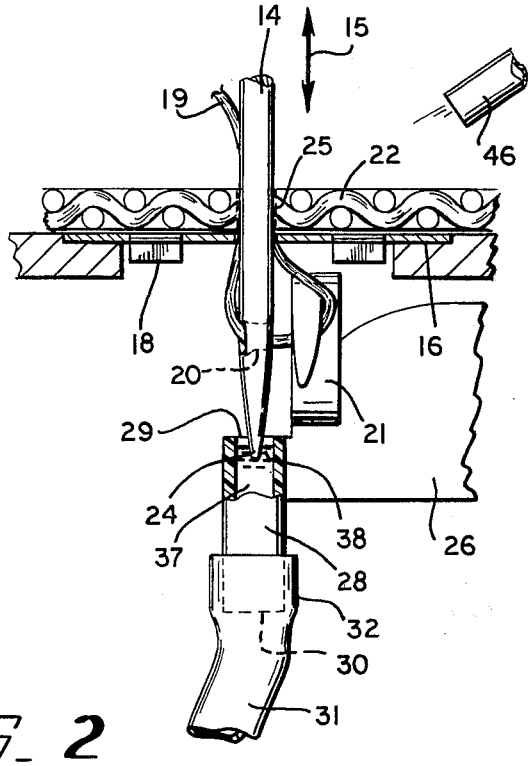
FIG. 2 is a side cross sectional view of the lower end of a sewing needle, the throat plate, feed dogs, looper, needle guard and lubricant container, showing the tip of the sewing needle immersed in lubricant.

As illustrated in FIG. 2, the needle 14 reciprocates as indicated by the double-headed arrow 15 through an opening in throat plate 16 between feed dogs 18, carrying the needle thread 19 through the eye 20 of the needle, and the looper 21 engages the needle thread and holds the thread in the material 22 as the needle 14 retracts. The material 22 can be woven cloth or various types of natural or synthetic materials, and the material is illustrated as moving into the drawing figure.

Figure 3:
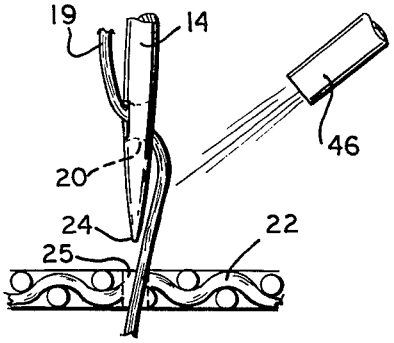
FIG. 3 is a side detail view of the sewing needle, showing the needle withdrawn from the material being sewn.

As needle 14 reciprocates, its lower pointed portion or tip is repeatedly thrust through the material 22, and the tip functions to wedge apart the fibers of the material and to form an opening 25 through which the needle 14 and thread 19 pass. When the needle withdraws from the opening 25 (FIG. 3) the opening 25 does not close immediately about the tip of the needle.

Needles guard 26 is located beneath the throat plate 16, and a small copper tube 28 is rigidly connected to needle guard 26. Copper tube 28 is open ended, having an upper open end 29 and a lower open end 30, and the length of copper tube 28 is aligned with the length of needle 14. The upper open end 29 of tube 28 is placed at an elevation higher than the lowest point of movement of the tip 24 of needle 14, so that the tip 24 enters the upper open end 29 of the tube 28 on each reciprocation of the needle.

Conduit 31 has one of its ends 32 connected to the lower end of copper tube 28, and the conduit 31 extends to a level higher than copper tube 28 so that its other end 34 is connected to the lower opening of a receptacle 35. Receptacle 35 is mounted on a bracket 36 on work table 11 adjacent the sewing machine 10, and a liquid lubricant, such as silicon, is placed in the receptacle. The liquid lubricant moves from receptacle 35 downwardly through conduit 31 to copper tube 28 under the influence of gravity and fills the copper tube to a level 38 at the upper open end 29 of tube 28. Thus, tube 28 functions as a container for the liquid lubricant 37, and the tip 24 of needle 14 is immersed in the liquid 37 during the reciprocation of the needle. As the lubricant adheres to the tip of needle 24 and the supply of lubricant liquid 37 in tube 28 would be depleted; however, additional lubricant liquid will be urged under the influence of gravity from receptacle 35 downwardly through conduit 31, so that a ready supply is always maintained in the tube 28.

Receptacle 35 is fabricated from flexible material and includes a lid 39 which is capable of being hermetically sealed to the container. A vent opening (not shown) is formed in lid 39, to avoid drawing a low pressure in the top of the container 35 and inadvertently stoping the movement of liquid through conduit 31. When liquid has been poured into the receptacle 35, the lid is attached to the receptacle to close the receptacle, and the operator can place a finger over the vent opening to temporarily seal receptacle 35, and then compress the receptacle to charge conduit 31 with the liquid lubricant.

The receptacle 35 is located at a height above tube 28 that causes the liquid lubricant 37 to assume its level 29 at the upper end of tube 28. If the lubricant is not moved through the conduit 31 as desired, possibly due to a change in viscosity of the liquid lubricant because of a change in temperature, the bracket 36 can be raised or lowered to increase or reduce the head of the lubricant. In most situations, the environmental conditions about the sewing machine will be relatively constant so that once the receptacle 35 has been positioned on work table 11, its level will not have to be changed.

As illustrated in FIG. 1, a second bracket 40 is mounted on work table 11 and supports a second lubricant receptacle 41. Lubricant receptacle 41 is similar to receptacle 35 in that it functions as a reservoir and includes a bottom opening (not shown) for the drainage of lubricant therefrom. Lubricant receptacle 41 is mounted over a pair of strips of felt 42 and 43, with the felt strips 42 and 43 and receptacle 41 being mounted on bracket extension 45. The needle thread 19 is directed between the felt strips 42 and 43 as it moves from its supply (not shown) to the sewing machine 10. The felt strips 42 and 43 wick the liquid from receptacle 41, thus becoming substantially saturated with the lubricant liquid, so that the thread 19 is substantially impregnated with the lubricant liquid as it moves on toward sewing machine 10. When the thread 19 reaches the eye 20 of sewing machine needle 14, the lubricant in the thread tends to accumulate to some extent in the eye of the needle, causing a reduction in the friction between the thread 19 and needle 14, thereby reducing the drag of the thread as it is pulled on into the sewing machine. Also, the lubricant is spread to the looper 21 and to the other mechanical elements of the sewing machine by atomization of the lubricant from the rapid movement of the thread 19 beneath the throat plate 16 and because of the atomization of the lubricant 37 in tube 28 by the continual thrusting of the tip 24 of the needle 14 into the lubricant.

When the needle 14 is withdrawn from the material 22, the opening 25 does not immediately close about the tip portion 24 of the needle, so that a substantial amount of the lubricant remains on the tip of the needle and is carried with the needle as it moves toward its next penetration of the material 22. Thus, the lubricant functions to reduce the friction between the needle and the material as the needle is thrust into the material.

As illustrated in FIG. 1, conduit 46 includes an open end 48 directed toward needle 14 of sewing machine 10. Conduit 46 extends from a supply of air and directs a cooling stream of air toward the needle during the operation of the sewing machine, to cool the needle. In order to enhance the cooling function of the stream of air from conduit 46, the stream of air is reduced in temperature. In the embodiment illustrated, the airstream is cooled through a centrifuge process, where, due to Boyle's law the temporary reduction of pressure of a moving stream of air cools the air, and the cooled air is then directed to the needle. Of course, a conventional refrigeration system or other cooling means can be utilized to cool the air directed toward the sewing needle.

While this invention has been disclosed in connection a conventional sewing machine, it should be apparent that the method and process disclosed herein can be utilized with other types of sewing equipment, including tufting equipment. The phraseology "sewing machine" is used in a broad sense. Also, while liquid silicon has been disclosed as the liquid lubricant, it is anticipated that other types of lubricants can be used, as may be desired.

While this invention has been described in detail with particular reference to a preferred embodiment thereof, it will be understood that variations and modifications can be effected within the spirit and scope of the invention as described hereinbefore and as defined in the appended claims.

We claim:

1. Apparatus for treating the tip of a sewing machine needle as the needle tip reciprocates from a position above the work piece, downwardly through the work piece to a position at a predetermined distance below the work piece, and then upwardly back through the work piece during its sewing function, said apparatus comprising an open ended tube for receiving a liquid lubricant therein, means for positioning said tube in the path of the needle tip with one of its openings supported in a stationary position facing upwardly and in alignment with the needle tip and at a distance below the work piece which is less than the distance the needle tip travels in a downward direction below the work piece so that the tip of the needle enters the upper opening of the tube as it reaches the bottom of its downward stroke, and means for supplying a liquid medium only lubricant to said tube through the other end of said tube to form a body of liquid medium only lubricant in said tube with a surface maintained at a level higher than the lowest movement of the needle tip, whereby the tip of the needle contacts the surface of the liquid medium lubricant in the tube as the needle reaches the bottom of its downward stroke.

2. In a sewing machine including a reciprocatable sewing needle having a pointed tip movable from above the path of a layer of material to be sewn down through the material to a position at a predetermined distance below the layer of material, the improvement comprising a liquid lubricant container positioned below the path of the material and defining an upwardly facing opening, means for supporting said lubricant container with its upwardly facing opening supported in a stationary position in alignment with the movement of said needle tip at a distance below the layer of material which is less than the distance that the needle tip moves below the layer of material, said opening being positioned to receive the tip of said needle in said container during movement of said needle downwardly through the material as the needle reaches the bottom of its downward stroke, and lubricant receptacle means in communication with said container for continuously supplying said container with a liquid lubricant, said lubricant receptacle means and said lubricant container being constructed and arranged to maintain a body of liquid medium only lubricant at a surface level higher than the lowest movement of said needle tip, whereby the pointed tip of the needle contacts the surface of the liquid medium lubricant as the needle reaches the bottom of its downward stroke.

3. The improvement of claim 2 and wherein said lubricant container comprises an open ended tube with one of its openings aligned with the path of the reciprocable needle and its other opening in fluid communication with said lubricant receptacle.

4. The improvement of claim 2 and wherein said means for supporting said lubricant container comprises a needle guard.

* * * * *